United States Patent [19]

Baldenko et al.

[11] Patent Number: 4,556,398

[45] Date of Patent: Dec. 3, 1985

[54] HINGE JOINT FOR A SCREW PLANETARY HYDRAULIC DRILL

[75] Inventors: Dmitry F. Baldenko; Yury V. Vadetsky, both of Moscow; Vladimir B. Goldobin, Perm; Moisei T. Gusman, Moscow; Anatoly M. Kochnev; Samuil S. Nikomarov, both of Perm; Valery I. Semenets, Moscow, all of U.S.S.R.

[73] Assignee: Vsesojuzny Nauchnoissledovatelsky Institut Burovoi Tekhniki, Moscow, U.S.S.R.

[21] Appl. No.: 631,519

[22] PCT Filed: Apr. 28, 1981

[86] PCT No.: PCT/SU81/00042

§ 371 Date: Mar. 12, 1982

§ 102(e) Date: Mar. 12, 1982

[87] PCT Pub. No.: WO82/03886

PCT Pub. Date: Nov. 11, 1982

Related U.S. Application Data

[63] Continuation of Ser. No. 359,656, Mar. 12, 1982, abandoned.

[51] Int. Cl.[4] ..... E21B 4/02

[52] U.S. Cl. ..... 464/16; 277/212 F; 464/154

[58] Field of Search ..... 277/212 R, 212 F, 212 FB; 403/50, 51, 134; 464/7, 16, 106, 147, 153, 154, 158, 159, 182

[56] References Cited

U.S. PATENT DOCUMENTS

| | | | |
|---|---|---|---|
| 1,440,847 | 1/1923 | Sundh | 464/7 X |
| 2,134,302 | 10/1938 | Haushalter | 277/212 F |
| 2,670,976 | 3/1954 | Owen | 277/212 F X |
| 2,841,966 | 7/1958 | Belden et al. | 464/16 X |
| 2,924,954 | 2/1960 | Panhard | 464/154 X |
| 2,975,620 | 3/1961 | Shipley et al. | 464/154 X |
| 3,469,854 | 9/1969 | Linwood | 277/125 X |
| 3,651,662 | 3/1972 | Hoffman | 464/16 |
| 3,669,459 | 6/1972 | Bass | 277/212 F X |
| 3,897,070 | 7/1975 | Anderson et al. | 277/212 F X |
| 3,921,989 | 11/1975 | Ward | 277/212 F X |
| 3,973,782 | 8/1976 | Evans | 277/212 F X |
| 3,999,901 | 12/1976 | Tschirky | 175/107 X |
| 4,066,269 | 1/1978 | Linne | 277/DIG. 6 X |

FOREIGN PATENT DOCUMENTS

| | | | |
|---|---|---|---|
| 1204854 | 9/1970 | United Kingdom | 277/212 F |
| 395634 | 8/1973 | U.S.S.R. . | |
| 543730 | 1/1977 | U.S.S.R. | 464/154 |
| 590518 | 1/1978 | U.S.S.R. | 464/154 |

*Primary Examiner*—Stuart S. Levy
*Assistant Examiner*—Daniel P. Stodola
*Attorney, Agent, or Firm*—Burgess, Ryan & Wayne

[57] ABSTRACT

A casing having a gear ring formed on its inner wall and closed at each end with a cover is provided with two half-couplings arranged coaxially and having outer gear rings engaging the gear ring of the casing. A ball is disposed between the two half-couplings and the interior is filled with a lubricant. A seal is placed in the casing between each cover and the respective end face of the gear ring. Each seal is made out of an elastic material in the form of a sleeve embracing the half-coupling, and has one end abutting upon the end face of the gear ring and its other end secured to the half-coupling.

5 Claims, 4 Drawing Figures

HINGE JOINT FOR A SCREW PLANETARY HYDRAULIC DRILL

This is a continuation of U.S. Ser. No. 359,656, filed Mar. 12, 1982, now abandoned.

TECHNICAL FIELD

The present invention relates to drilling equipment and, more particularly, to hinge joints of screw planetary hydraulic drilling machines permitting the transmission of force between the shafts disposed at an angle and varying in the course of the machine operation.

BACKGROUND OF THE INVENTION

Known in the art is a hinge joint for a screw planetary hydraulic drilling machine, comprising two universal joints interconnected by means of a shaft.

Each universal joint comprises a cylindrical casing whose inner wall is provided with a gear ring made therein. The casing houses two half-couplings which are arranged coaxially and engage the gear ring of the casing. The butt ends of the half-couplings, facing each other, have hemispheres made in the middle thereof to accomodate a ball, the radius of the latter being smaller than that of the hemispheres by a value proportional to the angle of turning of the hemispheres relative to the joint casing.

The casing is closed from the opposite sides with covers placed therein by means of a screw joint. The space between the gear rings of the half-couplings and the casing is filled with lubricant and is insulated with seals placed in the casing between the covers and the butt ends of the casing gear ring. Each of the seals is made as a rubber ring tightly fitted with its outer cylindrical face into the joint casing and with its inner face onto a half-coupling. Disposed at both sides of the ring on its flat end faces are rigid (metallic) rings of which one rests upon the gear ring of the casing and the other one contacts the inner butt end of the cover. In order to provide for skewness of the half-coupling relative to the joint casing, required in the course of operation, the rings have some gap provided between their inner diameter and the diameter of the half-couplings (see, for example, USSR Inventor's Certificate No. 543,730; Cl.E21B 3/12).

Displacement of the contacting faces of the rubber ring and the half-coupling, taking place under the action of the alternating contact load caused by pressing (oscillating) movement, results in additional one-sided deformation of the rubber rings. As a result of the non-uniform deformation of the rubber rings, the flushing fluid penetrates the gap formed between the rings and the half-coupling and, on getting into the joint space, washes out the lubricant.

Besides, high temperatures created during the well drilling cause, in the hinge joint employed in the drilling motor used for drilling oil and gas wells volumetric expansion of the lubricant which is squeezed out of the joint inner space. As a result, the gaps thus formed in the joint are filled up with the flushing fluid when the motor is lifted and the temperature drops.

A decreased amount of the lubricant and presence of the flushing fluid in the space of the universal joint result in a quick wearing of the gears of the rings of the half-couplings and the gears of the rings of the casing during transmission of the torque.

SUMMARY OF THE INVENTION

An object of the present invention is to provide a hinge joint for screw planetary hydraulic drilling machines, in which the constructive embodiment of the seal would be relatively simple in design and, at the same time, would considerably prolong service life as compared to the known hinge joints.

This object is accomplished by the fact that in a hinge joint for a screw planetary hydraulic machine, having two interconnected universal joints each comprises a casing having a gear ring made in its inner wall and closed with covers at each end, two half-couplings axially arranged in the casing and having outer gear rings engaging the rear ring of the casing and a ball disposed between them, and two seals mounted in the casing between the covers and the respective butt ends or end faces of the casing gear ring, in which hinge joint, according to the invention, each seal is made out of an elastic material as a hose or sleeve which embraces the half-coupling and one end portion of which is adapted to rest upon the end face of the casing gear ring and the other end portion is secured to the half-coupling.

It is expedient to make one end portion of the hose thicker and to mount it in a housing in the casing accomodating the thicker end portion of the sleeve.

This embodiment of the end portion of the sleeve and its accomodation in the housing increases the reliability in operation of the seal at the point of its contact with the joint casing.

It is no less expedient to make the thicker end portion of the seal multilayer with different hardness of the layers, the hardness being smaller the farther away the layer is from the surface contacting the end face of the gear ring of the casing.

The hardness of the layers of the thicker end portion changing in the radial direction ensures reliability of the seal between the casing and the outer cylindrical surface of the hose thicker end portion.

The hinge joint for a screw planetary hydraulic drilling machine, built in accordance with the present invention is relatively simple in design, reliable in operation and has a relatively long service life.

The fact that the seal is made out of an elastic material in the form of a hose or sleeve ensures preservation of lubricant in the space of the universal joint and prevents the flushing fluid from getting into its inner space. During operation of the hinge joint the contacting surfaces of the sleeve do not displace relative to the half-coupling and, consequently, no additional deformation of the hose is possible, which reduces wear of the packing joint and improves the hermetic sealing of the inner space of the universal joint and, consequently, prolongs the service life of the hinge joint.

BRIEF DESCRIPTION OF THE DRAWINGS

The following description of a specific exemplary embodiment of the present invention is given with reference to the accompanying drawings, in which.

DESCRIPTION OF THE INVENTION

Figure 1:
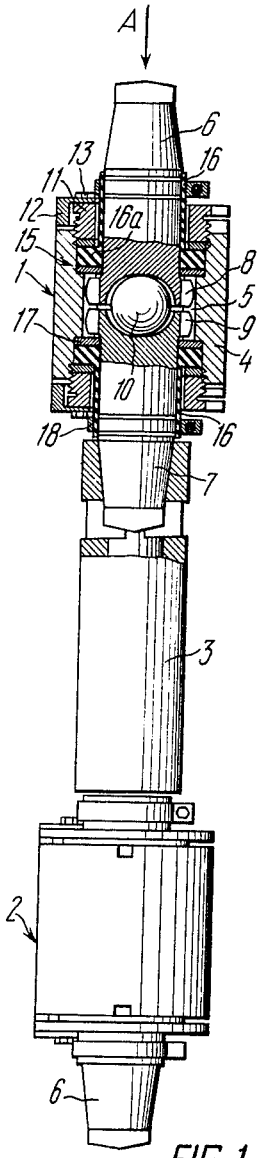
FIG. 1 shows a hinge joint for a screw planetary hydraulic drilling machine, one of the universal joints being partially shown in longitudinal section.

A hinge joint for a screw planetary hydraulic drilling machine comprises two universal joints 1 (FIG. 1) and 2 interconnected by a shaft 3. Both universal joints are made identical and, therefore, whatever is said in the following description relative to one of them is equally true with respect to the other one.

The universal joint 1 has a cylindrical casing 4 whose inner wall is provided with a gear ring 5 made therein. The casing 4 has half-couplings 6 and 7 which are arranged coaxially and have cylindrical and tapered portions. Made on the exterior circumference of the ends of the cylindrical portions of the half-couplings 6, 7, facing each other, are gear rings 8 and 9, respectively. The butt ends of the half-couplings have hemispheres made therein to accomodate a ball 10. The diameter of the ball 10 is smaller than the diameter of the hemisphere by a value proportional to the angle of turning of the half-coupling 7(6) relative to the joint casing 4.

Figure 2:
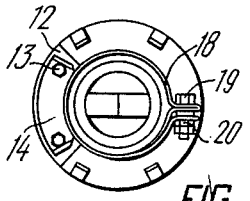
FIG. 2 is a plan view taken arrow "A" in FIG. 1.

The opposite ends of the casing are closed with covers 11 screwed thereto. The covers 11 are prevented against turning by strips 12 passing through slots of the covers 11 and the casing 4. The strip 12 is secured to the cover 11 with the aid of bolts 13 (FIG. 2) which are fixed against turning by bending a packing strip 14 over one of the edges of the bolt 13.

In order to raise the reliability of operation of each joint, the inner space around the ball 10 between the casing 4 and the two half-couplings 6 and 7 is filled with lubricant in such a manner that the work faces of the gear rings 5, 8 and 9 of the casing 4 and the half-couplings 6 and 7, respectively, operate constantly in the lubricant medium.

Placed in the casing 4 (FIG. 1) between the covers 11 and the respective inner end faces of the gear ring 5 of the casing 4 are seals 15. Each seal comprises a sleeve 16 made out of an elastic material, embracing the cylindrical portion of the half-coupling 6(7). One end of the sleeve 16, facing the gear ring 5 of the casing 4, is adapted to rest upon the end face of the gear ring, for which purpose it has a thicker portion 16*a* and rests on a metallic ring 17 placed between the sleeve 16 and the end face of the gear ring 5.

The other end of the sleeve 16 is secured to the end portion of the half-coupling 6(7), protruding beyond the cover 11, with the aid of a clamp 18, a bolt 19 (FIG. 2) and a nut 20. An annular groove is provided on the stem of the half-coupling, to provide a seat for the portion of the sleeve being clamped. This insures holding of the sleeve even during the most violent operation.

Figure 3:
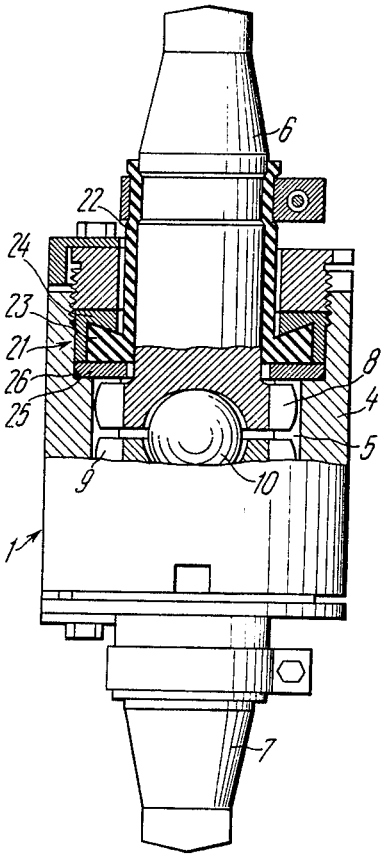
FIG. 3 is an enlarged sectional view of a universal joint showing a thicker sleeve end portion accomodated in a housing.

FIG. 3 shows a seal 21 in which one end of a sleeve 22 has a shaped thicker portion 23 and is placed into a holder 24 made as a ring and having a respectively shaped inner surface embracing the end of the sleeve 22.

The end of the sleeve 22 rests with the thicker portion 23 via a ring 25 upon the butt end of the gear ring 5.

The ring 25 can be arranged either free or connected to the sleeve 22.

The holder 24 and the ring 25 are made out of a material that is more rigid than the sleeve 22.

Placed between the casing 4 and the flat end face of the ring 25, facing the gear ring 5 of the casing 4, is a packing ring 26.

Figure 4:
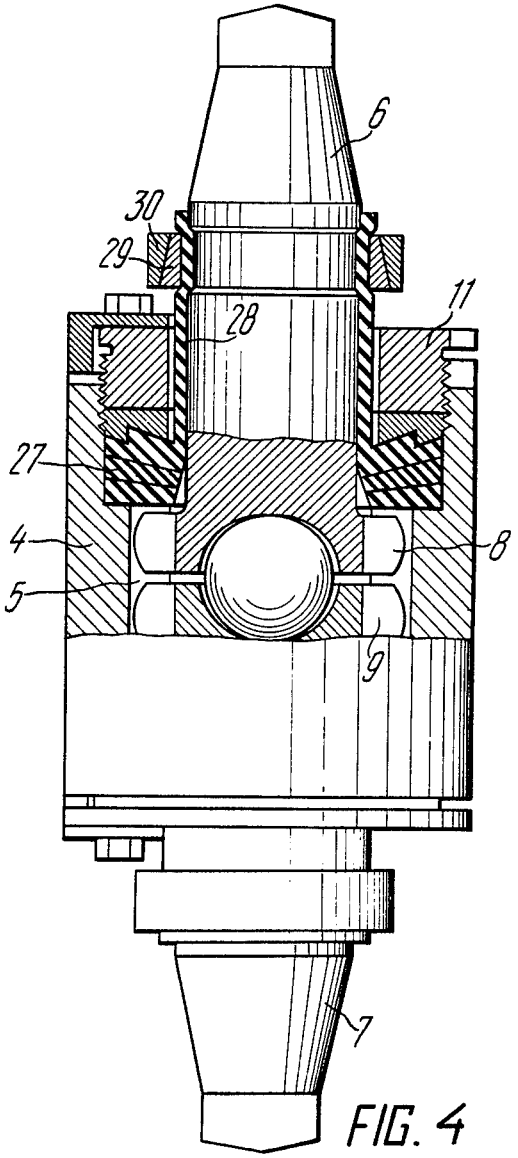
FIG. 4 is a view similar to FIG. 3 in which the thicker end portion of the sleeve is made multilayer.

A thicker portion 27 (FIG. 4) of a sleeve 28 may be made multilayer with different hardness of the layers, the hardness decreasing as the layer is placed farther away from the surface contacting the end face of the gear ring 5 of the casing 4. The sleeve 28 is secured to the cylindrical portion of the half-coupling 6 with the aid of two rings 29 and 30 contacting each other along their tapered faces. The ring 29 is made split and has an outer tape-red face. The ring 30 is made as one piece, has an inner taper and is mounted onto the outer tapered face of the ring 29, the latter narrowing in its diameter to clamp the hose 28 on the half-coupling 6. The value of the taper of the tapered faces of the rings 29 and 30 is so chosen as to preclude disengagement of the rings in the course of operation of the joint.

The hinge joint of the screw planetary hydraulic drilling machine operates as follows.

The half-couplings of the joints 1,2 are connected with their tapered portions to the motor rotor (not shown in the drawing) and to the shaft mounting the actuator (not shown in the drawing).

From the rotor the torque and axial force component are transmitted through the hinge joint to the shaft which is positioned eccentrically relative to the rotor and carries the actuator. Thereby the axes of the half-couplings 6 and 7 of each universal joint 1 and 2 intersect and the half-couplings 6 and 7 oscillate relative to the casing 4 of each joint.

From the rotor the torque is transmitted to the shaft of the acutator via the tapered portions of the half-couplings 6, 7, as well as via the gear rings 8, 9 and 5 of the half-couplings 6 and 7 and the casing 4, respectively, of each of the joints 1 and 2. As to the axial load, it is transmitted from the rotor by the same tapered portions of the half-couplings 6, 7 and the ball 10 via the respective surfaces of the hemispheres of the half-couplings 6 and 7, with which it contacts and between which it is disposed.

Employment of the seal made out of an elastic material as the sleeve 16 whose ends are secured to the casing 4 and the half-coupling 6(7) ensures preservation of the lubricant inside the space of the universal joint 1(2) and prevents the flushing fluid from getting into its inner space.

This is accomplished by the fact that in the course of operation of the hinge joint the contacting surfaces of the sleeve 16 are not displaced relative to the half-coupling 6(7) and the casing 4 as at its one end the outer surface of the hose 16 is tightly placed into the casing and is secured therein, whereas at the other end of the hose 16 the inner surface adjoins tightly the half-coupling 6(7) and is secured to its face. The elastic material of the sleeve 16 provides for free oscillation of the half-couplings 6 and 7 relative to the casing 4.

The presence of the shaped thicker portion 23 at the end of the sleeve 22 accomodated in the casing 4 and the holder 24 having an appropriately shaped surface embracing the thicker portion 23 increases reliability of operation of the seal.

The fact that the thicker portion 27 of the sleeve 28 is made multilayer with different hardness of the layers simplifies assembly of the universal joint without reducing in any way its operatability and reliability.

INDUSTRIAL APPLICABILITY

The hinge joint of the present invention is used for connecting the shaft of a screw planetary hydraulic drilling motor with the shaft carrying the actuator.

The hinge joint according to the present invention can be used in other branches of industry, wherever it it necessary to transmit force between shafts mutually disposed at an angle varying in the course of operation, for instance, in chemistry for employing the hinge joint for operation in agressive media.

We claim:

1. A universal hinge joint for a bottom-hole helical planetary hydraulic machine comprising a cylindrical casing having an inner gear ring formed on the inner wall thereof, a cover closing each end of said casing, two half couplings extending coaxially through each of said covers into said casing in opposition to each other, each half coupling having a hemispherical recess on its inner end and a gear on the outer surface thereof in meshing engagement with said inner gear ring, a ball disposed in the recesses between said half couplings, and a lubricant within said casing surrounding said inner gear ring, said outer gears and said ball, and a pair of seals for sealing each end of said casing respectively, each seal comprising an elastic cylindrical sleeve surrounding the corresponding half coupling and having a radially outwardly extending and axially thickened inner flange, and holding means formed of a material having a hardness substantially greater than that of the sleeve, said holding means comprising at least a first annular ring embracing the outer end surface of the flange and a second annular ring embracing the inner end surface of said flange, and said covers being secured at the respective outer end of said casing extending inwardly thereof against the first annular ring of the holding means to compress and secure said flange in abuttment with the associated end face of said inner gear ring, the outer end of said sleeve extending axially outward of said casing beyond said cover and being secured to said corresponding half coupling externally of said cover, the outer end of each of said half couplings is provided with an annular groove having a diameter substantially equal to the inner diameter of said sleeve, said sleeve being secured by a detachable clamp fitting over said sleeve into said groove.

2. The hinge joint according to claim 1 wherein the flange of each elastic sleeve is formed as a monolithic portion comprising a plurality of layers of elastic material of different hardness, the hardness decreasing as the layer is spaced from the end face of the gear ring, the axially inner most layer forming a portion of said holding means in abuttment with said inner gear ring.

3. The hinge joint according to claim 1 wherein the outer end surface of said flange is tapered inwardly and downwardly and the holding means is a metallic split ring having a cross-section conforming to said tapered surface.

4. The hinge joint according to claim 3 wherein said holding means include an annular metallic disc interposed between the flange and the inner gear ring.

5. A universal hinge joint according to claim 1, wherein each flange is axially thickened with respect to the respective sleeve throughout the entire radial dimension thereof.

* * * * *